United States Patent [19]

Tremoureux et al.

[11] Patent Number: 4,608,092

[45] Date of Patent: Aug. 26, 1986

[54] PROCESS FOR IMPROVING THE CORROSION RESISTANCE OF FERROUS METAL PARTS

[75] Inventors: Yves Tremoureux, Saint-Etienne; Jean-Luc Reynaud, Andrezieux-Boutheon, both of France

[73] Assignee: Centre Stephanois de Recherches Mecaniques Hydromecanique et Frottement, Andrezieux-Boutheon, France

[21] Appl. No.: 713,633

[22] Filed: Mar. 19, 1985

[30] Foreign Application Priority Data

Mar. 20, 1984 [FR] France ..... 84 04262

[51] Int. Cl.[4] ..... C23C 22/00; C23C 16/34; C23C 16/44; C23C 22/78

[52] U.S. Cl. ..... 148/6.11; 148/15

[58] Field of Search ..... 148/6.11, 15

[56] References Cited

U.S. PATENT DOCUMENTS 2,271,374 1/1942 MacKay ..... 148/6
4,448,611 5/1984 Grellet et al. ..... 148/6.11

FOREIGN PATENT DOCUMENTS 2717541 11/1977 Fed. Rep. of Germany .
2853542 6/1980 Fed. Rep. of Germany .
2463821 2/1981 France .
2056505 3/1981 United Kingdom .

OTHER PUBLICATIONS

Robin, Durand, Cot, Duprat, Bonnel and Dabosi: "Etude Physicochimique et Électrochimique de la Protection d'un Acier au Carbone par les Monofluorophosphates" in the Journal of Applied Electrochemistry 12 (1982), pp. 701–720.

Duprat, Bonnel, Dabosi, Durand and Cot: "Les Monofluorophosphates de Zinc et de Potassium en tant qu'Inhibiteurs de la Corrosion d'un Acier au Carbone en Solution de NaCl á 3%" in the Journal of Applied Electrochemistry 13 (1983), pp. 317–323.

*Primary Examiner*—Sam Silverberg
*Attorney, Agent, or Firm*—Young & Thompson

[57] ABSTRACT

A process for improving the corrosion resistance of ferrous metal parts also subject to heat and chemical treatment following nitriding in association or not with carburizing and/or sulfurizing essentially comprises immersing the parts in a known bath of molten salts to which is added a sufficient quantity of a halogenophosphate having formula:

$$M_2(PO_3X)_m$$

in which X and is fluorine and M is a metal of subgroup Ia, IIa or IIb of the periodic table of elements, having the valency m. The preferred halogenophosphate is sodium, potassium, calcium or zinc monofluorophosphate. The molten salt bath may be of the oxidizing type, comprising for example, 65% by weight KOH, 25% $NaNO_3$, 10% $Na_2CO_3$, or of the neutral type, for example a eutectic mixture of 50% $BaCl_2$, 30% $CaCl_2$, 20% NaCl. The halogenophosphate may be added in proportions of 0.1 to 20 g per kilogram of salt bath.

14 Claims, No Drawings

PROCESS FOR IMPROVING THE CORROSION RESISTANCE OF FERROUS METAL PARTS

BACKGROUND OF THE INVENTION

1. Field of the invention

The invention relates to a process for treating ferrous metal parts in order to improve their corrosion resistance in which the parts, which are also subjected to heat and chemical treatment including nitriding in association or not with carburizing and/or sulfurizing, are immersed in a bath of molten salts.

2. Description of the prior art

British Pat. No. 2,056,505 describes a bath of salts comprising alkali hydroxides and from 2 to 20% by weight of alkali nitrates. Immersed in it are ferrous metal parts which have been subjected to nitriding in a bath of molten salts including cyanides. The effect of the bath containing hydroxides and nitrates is firstly to destroy the cyanides and then, by further action, to improve the corrosion resistance.

U.S. Pat. No. 4,448,611 describes a bath of molten salts made up by adding to a known oxidizing bath from 0.5 to 15% by weight of oxygen-containing salts of alkali metals for which the normal oxidation-reduction potential relative to the hydrogen reference electrode is −1.0 V or below. The bath, intended in particular for treating ferrous metal parts containing sulfur in their surface layers, in order to improve their corrosion resistance, is implemented by blowing in an oxygen-containing gas, limiting the concentration of insolubles to below 3% by weight of the bath.

The state of the art process for improving corrosion resistance is essentially based on the formation on the surface of the parts of an adherent barrier layer of a stable oxidized compound, that is to say one featuring a high formation energy.

The use of oxidizing salt baths features inherent hazards of attack on the surroundings of the bath, pollution and explosion, these hazards being proportional to the oxidizing power of the bath, that is to say in the final analysis to the degree of corrosion protection achieved.

It therefore appears desirable to provide processes for treating ferrous metal parts in order to improve their corrosion resistance which are at least as effective from this point of view as the conventional oxidizing baths whilst not having the disadvantages associated with their oxidizing power, or having such disadvantages to a reduced degree in the event that the use of an oxidizing bath proves necessary to achieve a result other than corrosion resistance.

SUMMARY OF THE INVENTION

The invention consists in a process for improving the corrosion resistance of ferrous metal parts also subject to heat and chemical treatment following nitriding in association or not with carburizing and/or sulfurizing wherein said parts are immersed in a bath of molten salts containing a sufficient quantity of at least one halogenophosphate having the formula:

$$M_2(PO_3X)_m$$

in which X is fluorine and M is a metal of subgroup Ia, IIa or IIb of the period table of elements, having the valency m.

There have been known for a long time, in wet surface treatment processes intended to improve corrosion resistance, alongside chemical or electrochemical passivation using ionic bonds, sequestration treatments such as phosphating or the use of corrosion inhibiters. These treatments are also called conversion treatments. Although phosphating has been used for long-term corrosion resistance improvement, the action of the usual corrosion inhibiters ceases almost immediately after removing the parts from contact with the solution containing the inhibiters.

Moreover, phosphate protection is subject to the formation of cracks at which corrosion may break out and use is frequently made of complementary treatment, especially chromating, to prevent corrosion breaking out.

In an article "Etude physicochimique et électrochimique de la protection d'un acier au carbone par les monofluorophosphates" in the Journal of Applied Electrochemistry 12 (1982), pages 701–720, the authors Robin, Durand, Cot, Duprat, Bonnel and Dabosi studied the behavior in a 3% NaCl solution of a carbon steel (XC 38) which had been subjected to crystalline or amorphous phosphating followed by after-processing using potassium and zinc monofluorophosphates. The after processing achieved varying degrees of improvement in corrosion resistance, without such improvement offering clear advantages over the prior art. However, the improvement became significant when the steel was subsequently painted, the monofluorophosphate favoring adhesion of the paint film.

In an article published in the Journal of Applied Electrochemistry 13 (1983), pages 317–323, titled "Les monofluorophosphates de zinc et de potassium en tant qu'inhibiteurs de la corrosion d'un acier au carbone en solution de NaCl á 3%", the authors Duprat, Bonnel, Dabosi, Durand and Cot demonstrated the corrosion inhibiting action of the $PO_3F^{2-}$ ion when present in the treatment solution (3% NaCl).

The properties of the formation of phosphor and halogen (especially fluorine) complexes are known. The foregoing research confirmed that the monofluorophosphates were capable of forming complexes with ionic iron in the aqueous phase. However, as far as the applicants are aware, the behavior of halogenophosphates in a molten salt solution has never been investigated and the formation of corrosion-resistant sequestration layers from halogenophosphates in a molten salt solution has not been demonstrated. It was not forseeable that the protection effect, hardly any better in the aqueous phase than that of conventional chromating, would prove to be as marked in a molten salts phase.

There is preferably added to the conventional salt bath between 0.1 and 20 g of halogenophosphate per kilogram of bath. Note that the complex salt is effective at low concentrations, which confirms the high affinity of the halosalt for iron and its low reactivity in relation to the molten salts on which the bath is based.

A metal M selected from the group comprising subgroups Ia (alkali), IIa (alkaline earth) or IIb (zinc family) of the periodic table of elements is used.

Similarly, the halogen is fluorine. More specifically, the halogenophosphate is a monofluorophosphate.

The characteristics and advantages of the invention will, moreover, emerge from the following description including examples.

EXAMPLE 1

In a 200 liter electrically heated crucible there is melted a mixture of 162.5 kg of potassium hydroxide, 62.5 kg of sodium nitrate and 25 kg of sodium carbonate. The mixture is heated to 450° C. and then 500 g of sodium monofluorophosphate $Na_2PO_3F$ is added.

The typical treatment involves immersing the parts for 20 minutes at 450° C.

The test samples were of a non-alloyed type XC 38 steel containing 0.38% carbon, in the annealed state. A first series was treated as such and a second series was first subjected to nitriding in a salt bath comprising sodium, potassium and lithium carbonates and cyanates, with a small amount of potassium sulfide added as an activator. The nitrided layer contains approximately 87% by weight of the $\epsilon$ nitride and 10% of the $\nu'$ nitride, the remainder consisting of sulfides and oxysulfides.

The parts were subjected to systematic salt mist corrosion tests as per standard NF X4 1002. The results (time of exposure to appearance of first traces of corrosion) are recorded in Table 1 below. The test codes have the following meanings:

A: samples as such, neither nitrided nor treated in the fluorophosphate bath as aforementioned;

B: nitrided parts, not treated in the fluorophosphate bath;

C: non-nitrided parts, treated in the fluorophosphate bath;

D: nitrided parts treated in the fluorophosphate bath.

TABLE 1

| Test | Exposure time (hours) |
|---|---|
| A | <10 |
| B | 55 |
| C | 30 |
| D | 450 |

Comparing A and C, note that the fluorophosphate bath produces a significant improvement in corrosion resistance. However, this is not so good as that obtained by nitriding itself.

However the fluorophosphate treatment as a complement to nitriding achieves a remarkable improvement in corrosion resistance.

EXAMPLE 2

The operation is as in Example 1, the nitrided parts having been subjected to gas nitriding with plasma assistance (ionic nitriding). The nitrided parts subsequently treated in the fluorophosphate bath feature an exposure time (up to the appearance of the first traces of corrosion) of 400 hours.

EXAMPLE 3

The tests of Examples 1 and 2 were repeated using a salt bath of the same basic composition (in hydroxides, nitrates and carbonates to which were added 500 g of sodium monochlorophosphate $Na_2(PO_3Cl)$. Results analogous to those of examples 1 and 2 are obtained, the improvement in corrosion resistance due to the chlorophosphate being not so great, however. Laboratory work using bromophosphate and iodophosphate also leads to substantial improvements in corrosion resistance, but still not so high as that obtained with chlorophosphate.

EXAMPLE 4

Analogous tests were carried out using calcium fluorophosphate $Ca(PO_3F)$ and zinc fluorophosphate $Zn(PO_3F)$. The potassium and calcium salts give results practically identical to those for the sodium salts. The zinc salt also gives highly comparable results.

EXAMPLE 5

A bath is made up comprising, by weight, 50% calcium chloride, 30% barium chloride and 20% sodium chloride; this is a substantially eutectic mixture and melts at 460° C. The bath is heated to 480° C. and 10 g/kg of sodium monofluorophosphate added to it.

Parts as in Example 1 are used, with an immersion time also of 20 minutes. The results are set out in Table 2 below, the test codes having the same meaning as for Table 1.

TABLE 2

| Test | Exposure time (hours) |
|---|---|
| A | 10 |
| B | 55 |
| C | 380 |

It is remarkable to obtain so great an improvement in the corrosion resistance of nitrided parts using a salt bath which is of itself neutral and to which a halogenophosphate is added. The improvement is, it is true, slightly inferior to that obtained in example 1, but note that the use of an oxidizing bath of itself procures a significant improvement in corrosion resistance; the exposure times for steel parts processed in accordance with U.S. Pat. No. 4,448,611 reach or exceed 250 hours. Note that the improvement obtained in the present case is greater than that obtained by oxidizing bath treatment and that the combination of the oxidizing bath and the halogenophosphate yields still greater improvement.

Moreover, it is beneficial to implement salt bath treatment processes capable of conferring on ferrous metals corrosion resistance at least equal to that obtained by the known processes, with very much increased safety of use, by virtue of the non-toxicity of the halogenophosphates, and the elimination of fire and explosion hazards associated with the use of oxidizing baths.

Tests have been carried out to evaluate the effective concentrations of halogenophosphates.

These tests were conducted by progressively enriching the salt bath in halogenophosphate and verifying the efficiency each time. It was found that an addition of 0.5 g per kg of bath yielded a detectable improvement. The improvement becomes clearly significant from 8 g/kg. Moreover, above 15 g/kg there is no further really significant improvement.

It will be understood that various changes in the processes and materials which have been herein described and illustrated in order to explain the nature of the invention may be made by those skilled in the art within the principle and scope of the invention as expressed in the appended claims.

What we claim is:

1. A process for improving the corrosion resistance of ferrous metal parts also subject to heat and chemical treatment including nitriding in association or not with carburizing and/or sulfurizing wherein said parts are immersed in a bath of molten salts containing a sufficient quantity of at least one halogenophosphate having one of the following formulas:

$M_2/m(PO_3X)$ in which X is fluorine and M is a metal of one of subgroups Ia, IIa and IIb of the periodic table of elements, having the valency m.

2. Process according to claim 1, wherein said bath of molten salts comprises between 0.1 and 20 g of halogenophosphate per kilogram of bath.

3. Process according to claim 1, wherein M is an alkali metal.

4. Process according to claim 1, wherein M is calcium.

5. Process according to claim 1, wherein M is zinc.

6. Process according to claim 1, wherein said ferrous metal parts have been nitrided in a bath of salts comprising alkali carbonates and cyanates.

7. Process according to claim 6, wherein said bath of alkali carbonates and cyanates is activated using sulfur.

8. Process according to claim 1, wherein said ferrous metal parts have been gas nitrided.

9. Process according to claim 8, wherein said gas nitriding is plasma-assisted.

10. Process according to claim 1, wherein said bath of molten salts is an oxidizing bath containing alkali metal nitrate and hydroxide.

11. Process according to claim 10, wherein said oxidizing bath further contains alkali metal carbonate.

12. Process according to claim 10, wherein said oxidizing bath contains approximately 65% by weight potassium hydroxide, 25% sodium nitrate and 10% sodium carbonate.

13. Process according to claim 1, wherein said bath of molten salts contains alkali metal and/or alkaline earth chloride or chloride mixture.

14. Process according to claim 13, wherein said bath contains substantially eutectic proportions of calcium, barium and sodium chlorides.

* * * * *